United States Patent [19]

Kawamura et al.

[11] 4,322,604

[45] Mar. 30, 1982

[54] ENGINE START ASSISTING DEVICE

[75] Inventors: Hideo Kawamura, Yamato; Takahiko Itou, Tokyo, both of Japan

[73] Assignee: Isuzu Motors Limited, Kanagawa, Japan

[21] Appl. No.: 909,089

[22] Filed: May 24, 1978

[30] Foreign Application Priority Data

May 24, 1977 [JP] Japan ..... 52/60208

[51] Int. Cl.[3] ..... H05B 1/02

[52] U.S. Cl. ..... 219/497; 123/179 H; 123/145 A; 219/270; 219/505; 219/523; 338/330

[58] Field of Search ..... 219/270, 501, 505, 497, 219/523, 541; 123/179 H, 179 B, 179 BG, 145 A, 145 R; 338/329, 330; 361/264, 265, 266

[56] References Cited

U.S. PATENT DOCUMENTS

| | | | |
|---|---|---|---|
| 2,485,496 | 10/1949 | Korsgren et al. | 219/270 |
| 2,840,067 | 6/1958 | Carlson | 123/145 A |
| 3,017,541 | 1/1962 | Lawser | 123/145 A |
| 3,297,914 | 1/1967 | Saintsbury | 361/264 |
| 3,412,290 | 11/1968 | Hempson | 123/145 A |
| 3,520,043 | 7/1970 | Darling | 219/553 |
| 3,718,425 | 2/1973 | Weyl et al. | 123/145 A |
| 3,792,959 | 2/1974 | Mori et al. | 361/264 |
| 4,002,882 | 1/1977 | McCutchen | 219/497 |
| 4,088,109 | 5/1978 | Woodruff et al. | 123/179 H |
| 4,107,510 | 8/1978 | Tombs et al. | 123/145 A |
| 4,112,577 | 9/1978 | Mann | 123/145 A |
| 4,137,885 | 2/1979 | Van Ostrom | 123/179 BG |
| 4,177,785 | 12/1979 | Sundeen | 123/179 H |

FOREIGN PATENT DOCUMENTS

| | | | |
|---|---|---|---|
| 47-30068 | 8/1972 | Japan | 123/179 H |

*Primary Examiner*—B. A. Reynolds
*Assistant Examiner*—M. H. Paschall
*Attorney, Agent, or Firm*—Sughrue, Mion, Zinn, Macpeak and Seas

[57] ABSTRACT

The warm-up time of a glow plug starting device in a diesel engine is reduced by using as the material for the heat generating element in the glow plug a metallic resistance material whose resistance up to the starting temperature is less than two-thirds of the rated resistance of a conventional element. The starter circuit includes a detecting resistor in series with the heating element and a divider which divides the voltage across the heating element by the voltage across the detecting resistor in order to accurately determine the resistance and, thus, the temperature, of the heating element. The current to the element is interrupted and a self-holding starting relay is energized when the starting temperature has been obtained.

2 Claims, 5 Drawing Figures

ENGINE START ASSISTING DEVICE

BACKGROUND OF THE INVENTION

This invention relates to a device for assisting the starting operations of engines, and more particularly to a device for assisting the starting operation of a diesel engine having glow plugs.

In most of conventional diesel engines, especially in diesel engines having a preheating chamber, the engines are started by using glow plugs.

This method of utilizing glow plugs is advantageous in that the necessary device is simple and the engine can be readily started. However, the method is still disadvantageous in that it takes 20–30 seconds to preheat the glow plugs; that is, the engine starting characteristic is very poor.

SUMMARY OF THE INVENTION

Accordingly, an object of this invention is to eliminate the above-described drawback accompanying the conventional method in which glow plugs are utilized for starting the engine. More specifically, an object of the invention is to provide a novel engine start assisting device in which the preheating time of the glow plugs is considerably reduced and the engine starting characteristic is excellent.

Briefly, this is accomplished by providing a voltage source in series with a switch, detecting resistor and the glow plug heating element and measuring the resistance of the heating element as an accurate indication of temperature. When the desired operating temperature is reached, the switch is opened and a starter relay having a self-holding function is energized. The heating element is made of a metallic resistance material whose resistance R, as the element is heated from room temperature, is less than two-thirds of the rated resistance of a similar conventional glow plug, thus enabling a current of 1.5 times the conventional rated current to be supplied to the element for quick heating.

DETAILED DESCRIPTION OF THE INVENTION

Figure 1:
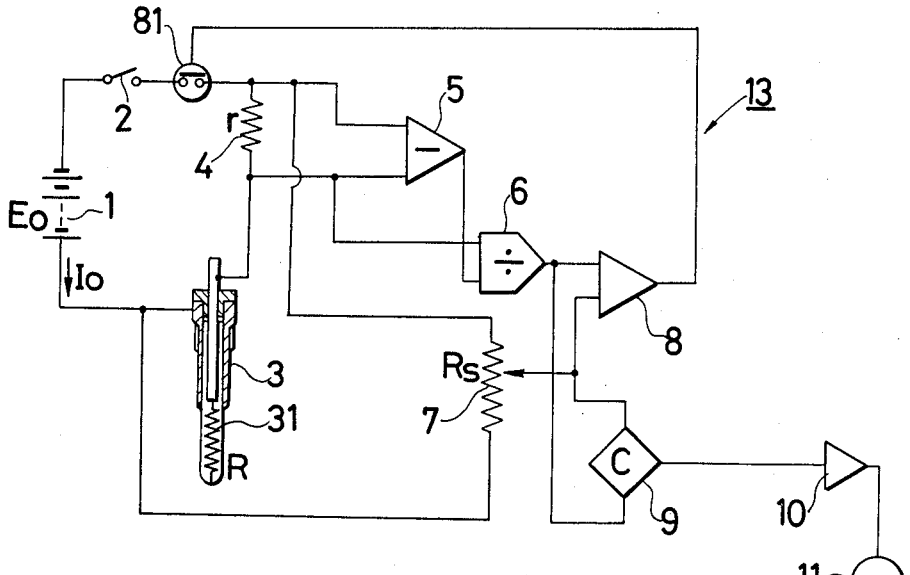
FIG. 1 is a circuit diagram, partly as a block diagram, showing one embodiment of the invention.

One embodiment of this invention will be described with reference to the accompanying drawing, in which reference numeral 1 designates a power supply; reference numeral 2, a start switch; reference numeral 3, a glow plug which is provided in correspondence to the number of cylinders; reference numeral 31, a heat generating element of the glow plug 3; reference numeral 4, a detecting resistor having a very low resistance r, for example, 0.010 to 0.030 ohm; reference numeral 5, a voltage detecting subtractor; reference numeral 6, an effective-resistance detecting divider for detecting the resistance R of the heat generating element 31; reference numeral 7, a set resistor having a set resistance Rs corresponding to a set temperature Ts of the glow plug

3; reference numeral 8, a feedback amplifier also having the function of a switching regulator; reference numeral 81, a current control element cooperating with the amplifier 8, the current control element 81 being a switch for instance; reference numeral 9, a comparator adapted to subject the set resistance Rs and the effective resistance R to comparison; reference numeral 10, a transmission signal converting amplifier having a self-holding function; reference numeral 11, a starter relay; and reference numeral 12, a starter. All of the above-described components are connected as shown in FIG. 1 to form a control circuit 13.

The heat generating element 31 of the glow plug 3 is made of a metallic resistance material such that its resistance R, as the element is heated from room temperature by the continuous application of the supply voltage, is lower than $\frac{2}{3}$ of a rated resistance $R_T$ of a conventional similar glow plug until its temperature reaches the set temperature Ts. The resistance of element 31 at the set temperature, namely, the set temperature corresponding resistance Rs, is inherent from the glow plug material characteristics and is repeatable each time while the temperature is increased from room temperature to the set temperature Ts, and the resistance-temperature coefficient shows a value other than zero (0) at a temperature around the set temperature Ts.

The operation of the engine start assisting device thus organized according to the invention will be described.

When the start switch 2 is closed, the supply voltage Eo is applied across the glow plug 3 and the detecting resistor 4 connected in series, and, therefore, a current Io flows therein. As the control circuit 13 is connected to the detecting resistor 4 as shown in FIG. 1, the effective voltage E1 ($=E_o-e$, where e is the detection resistance voltage of the detecting resistor 4) of the heat generating element 31 of the glow plug 3 is detected in the subtractor 5, while the effective voltage E1 and the detection resistance voltage e are subjected to division in the divider 6.

In this case, the resistance R of the heat generating element 31 can be expressed by the following equation and is therefore varied according to the temperature T.

$$R=R_o(1+\alpha T)$$

where $R_o$ is the resistance of the heat generating element 31 at room temperature, $\alpha$ is the resistance-temperature coefficient, and T is the temperature increase measured from the room temperature.

Accordingly, the relational expressions concerning the control circuit 13 described above are as follows:

$$I_o \cdot r=e \quad (1)$$

$$E1=R\cdot I_o=R_o(1+\alpha T)\cdot I_o \quad (2)$$

$$E1=R\cdot e/r=(e/r)\cdot R_o(1+\alpha T) \quad (3)$$

The resistance R of the heat generating element 31 can be represented by the following equation (4)

$$R=E1r/e \quad (4)$$

The value R ($=E1r/e$) of equation (4) is directly proportional to the value calculated by the divider 6 described above and, therefore, the divider 6 serves as a device detecting the effective resistance (R) of the heat generating element 31.

The detection signal of the divider 6 is inputted into the feedback amplifier 8 and the comparator 9. The heat generating element 31 is quickly heated until the resistance R reaches the set resistance Rs corresponding to the set temperature Ts. When the resistance R reaches the set resistance Rs, the comparator 9 provides its output. This output is converted from a logical signal to an electrical signal by the amplifier 10 and is applied to the starter relay 11, as a result of which the starter 12 is started. At the same time, the switch 81 is opened by the operation of the amplifier 8, that is, the preheating circuit is opened, and therefore the preheating operation is temporarily suspended. Thereafter, when the energization is started and the set temperature corresponding resistance Rs is detected again, that is, the set temperature Ts is obtained, the amplifier 8 is operated again, as a result of which the switch 81 is opened to suspend the energization. The above-described operation is repeatedly carried out during the engine starting operation. Accordingly, even if voltage drop occurs during the rotation of the starter 12, the temperature of the glow plug is maintained at the set temperature Ts.

As was described above, in the engine start assisting device according to the invention, the heat generating element 31 of the glow plug 3 is made of a metallic resistance material such that its resistance R is lower than $\frac{2}{3}$ of the rated resistance $R_T$ of a conventional glow plug at all temperatures up to the set operating temperature Ts, the resistance Rs at the set temperature Ts is repeatable, and its resistance-temperature coefficient ($\alpha$) shows a value other than zero (0). Therefore, it is possible to apply a current 1.5 times the conventional rated current to the heat generating element 31. Accordingly, the heat generating element can be heated up in a very short time, that is, the preheating time can be considerably reduced.

Figure 2:
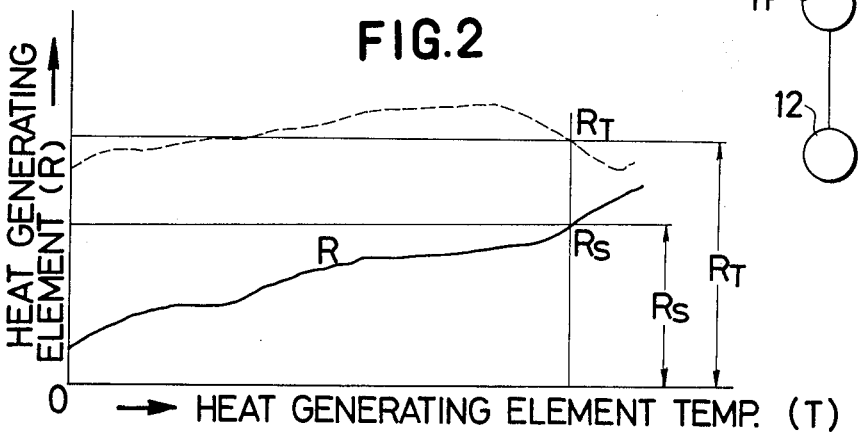
FIG. 2 is a graphical representation indicating the resistance-temperature characteristic of the heat generating element of a glow plug in the embodiment shown in FIG. 1.

This can be understood by briefly referring to FIG. 2. Conventional material used for the resistor R in the glow plug is nickel chrome, the temperature resistance characteristic of which is the upper dashed curve in FIG. 2. The curve is substantially constant in resistance value over the whole range of temperature, so that the required heat quantity to be supplied to the glow plug from the resistance R is determined only by time. More specifically, this can be described by way of the following equation.

$$\text{Heat Quantity} = W \times t = E^2 t/R$$

wherein E and R are constant.

On the other hand, the material used for the resistance R according to this invention is a pure metal, such as nickel, the temperature resistance characteristic of which is shown by the lower curve in FIG. 2. The curve is gradually increasing so as to satisfy the relationship of $R = R_O(1+\alpha t)$. In order to supply the same heat quantity as in the case of conventional nickel chrome, the required time is shorter since the resistance value is smaller.

The resistance R of the present heat generating element is always less than two-thirds of that of a conventional element up to the desired temperature Ts. Thus a larger current can be supplied. By way of example, the optimum operating temperature of a glow plug is 800° C. and a conventional plug requires approximately 20–30 seconds to attain this temperature from room temperature. In contrast, the present invention achieved this in approximately 3–5 seconds.

Figures 3, 4, 5:
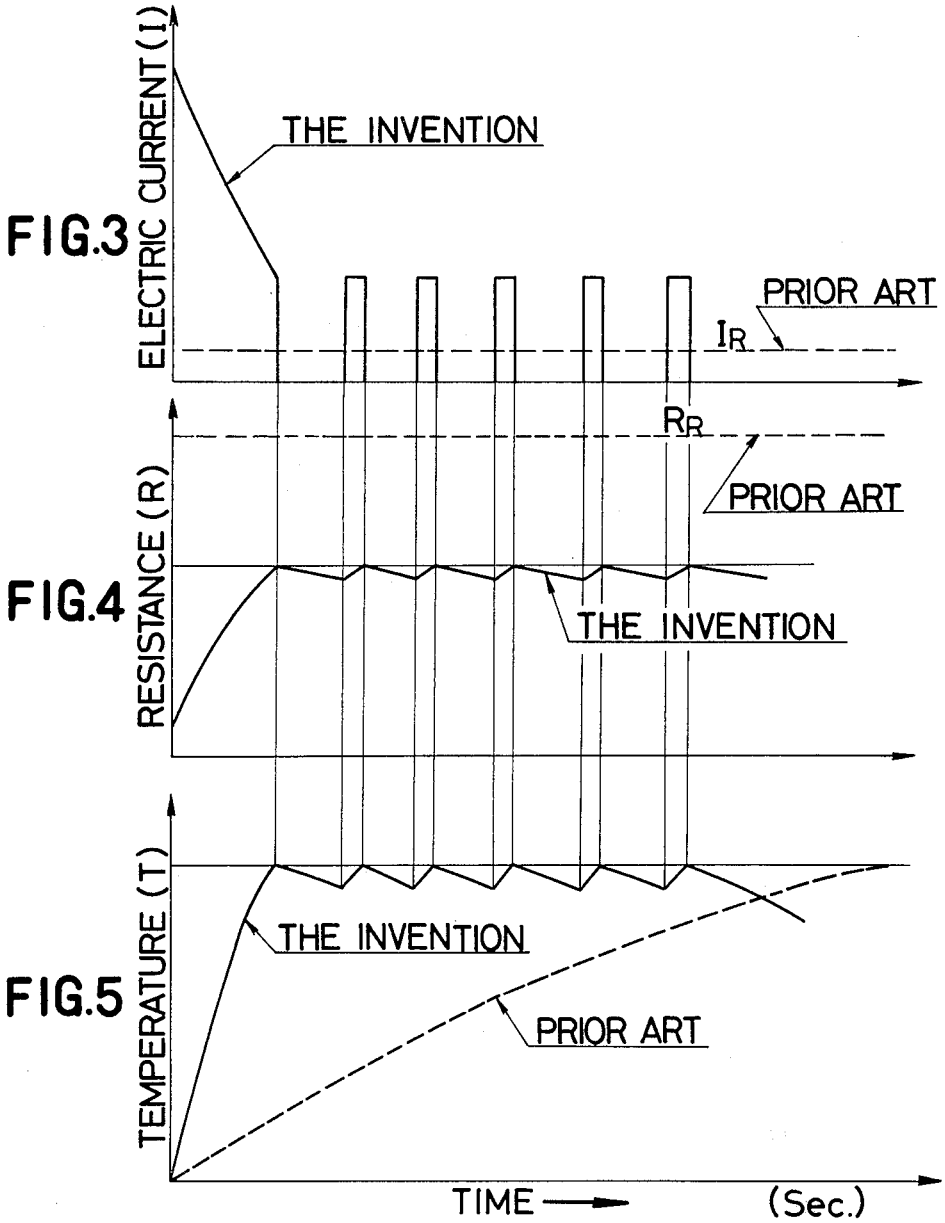
FIGS. 3, 4 and 5 are graphical illustrations of the operating cycle of the device according to the present invention.

Since the glow plug can be heated so quickly, it is possible to efficiently operate the system by periodically energizing the heating element. The operation of the device can be seen from the graphs of FIGS. 3, 4 and 5, in which FIG. 3 shows the current v. time characteristic of the plug, including the intermittent operation after the initial heating, and FIGS. 4 and 5 show the resistance v. time and temperature v. time, respectively.

Furthermore, in the engine start assisting device, the temperature of the heat generating element 31 is detected on the basis of its set resistance Rs and, therefore, the heating temperature T of the heat generating element 31 is detected with high accuracy. Therefore, even though the resistance R of the heat generating element 31 is lower than $\frac{2}{3}$ of the rated resistance $R_T$, the damage due to over-heating, such as the fusing of the heat generating element 31 due to over-current, can be prevented.

In addition, the engine start assisting device according to the invention is so designed that the output of the divider 6 and the set resistance Rs are subjected to comparison in the comparator 9 and, when both coincide with each other, the starter 12 is started through the amplifier 10 having a self-holding function and through the starter relay 11 by the output of the comparator. Accordingly, in the engine start assisting device according to the present invention, unlike the conventional one, the provision of independent preheating and starting devices is unneccessary. Therefore, the engine start assisting device according to the invention is very simple in construction. This is one of the significant advantages of the invention.

In the above-described embodiment, the transmission signal converting amplifier 10 has a self-holding function; however, the engine start assisting device may be so designed that the starter relay 11 has a self-holding function, or both of the amplifier 10 and the starter relay 11 have the self-holding function.

Furthermore, the output signal of the comparator 9 may be replaced by the current interrupting signal of the feedback amplifier 8.

As is apparent from the above description, according to the invention, an engine start assisting device is provided in which the preheating time of the glow plug can be greatly reduced, the construction is simple and the start characteristic is excellent.

The resistance is always less than two-thirds of conventional heating element resistances at corresponding temperatures. Thus, from the above equation, the maximum time $t_1$ required to heat the glow plug would be given by $$\frac{Et^2}{R} = \frac{Et_1^2}{0.66R}$$

or $$t_1 = \sqrt{\frac{2}{3}}\ t.$$

Since t, the conventional time requirement is usually 20–30 seconds, the maximum time $t_1$ would be approximately 16 seconds. However, since the heat generating element resistance has a positive temperature coefficient, the time requirement will be much lower, for example, less than 10 seconds when a conventional 12 or 24 volt diesel engine power supply is used.

What is claimed is:

1. In an engine starting assistance device of the type in which a glow plug having a heat generating element therein is heated by a current from a vehicle power supply to a desired set temperature in order to aid in starting said engine, the improvement characterized in that:

said heat generating element of said glow plug has only a positive temperature coefficient and has a resistance sufficiently low to enable said glow plug to be heated by the current to a desired set temperature of approximately 800° C. in a period of time less than 10 seconds; and said heat generating element of said glow plug has a known set resistance at said desired set temperature; and comprising detecting means for detecting the resistance of said heat generating element of said glow plug and for producing a control signal when the detected resistance equals said set resistance, and control means responsive to said control signal for intermittently interrupting the current flowing through said heat generating element;

said detecting means comprising: a set resistor having a resistance equal to said set resistance; comparator means, responsive to voltage signals derived from said heat generating element and from said set resistor, for producing said control signal; a fixed detecting resistor connected in series with said heat generating; a subtractor circuit connected across said detecting resistor; and divider circuit means connected to the output of said subtractor circuit and to the junction of the series-connected detecting resistor and heat-generating element for producing said voltage signal derived from said heat-generating element.

2. An engine starting assistance device according to claim 1 wherein the engine has a starter motor, and further comprising means responsive to said control signal for energizing said starter motor to crank said engine.

* * * * *